US008332133B2

(12) United States Patent
Ferro et al.

(10) Patent No.: US 8,332,133 B2
(45) Date of Patent: Dec. 11, 2012

(54) METHOD AND DEVICE FOR PROCESSING A REQUEST MESSAGE RECEIVED IN AN AIRCRAFT, FROM GROUND CONTROL, VIA A DATA TRANSMISSION SYSTEM

(75) Inventors: Daniel Ferro, Muret (FR); Jerome Chaptal, Toulouse (FR)

(73) Assignee: AIRBUS Operations (S.A.S.), Toulouse (FR)

( * ) Notice: Subject to any disclaimer, the term of this patent is extended or adjusted under 35 U.S.C. 154(b) by 61 days.

(21) Appl. No.: 12/962,957

(22) Filed: Dec. 8, 2010

(65) Prior Publication Data

US 2011/0166772 A1 Jul. 7, 2011

(30) Foreign Application Priority Data

Dec. 8, 2009 (FR) ..... 09 58765

(51) Int. Cl.
*G08G 5/00* (2006.01)

(52) U.S. Cl. ..... 701/120; 701/3

(58) Field of Classification Search ..... 701/120, 701/3

See application file for complete search history.

(56) References Cited

U.S. PATENT DOCUMENTS

| | | | | |
|---|---|---|---|---|
| 6,313,759 | B1 * | 11/2001 | Musland-Sipper | 340/945 |
| 6,317,659 | B1 * | 11/2001 | Lindsley et al. | 701/1 |
| 7,418,319 | B2 * | 8/2008 | Chen et al. | 701/14 |
| 2005/0181787 | A1 * | 8/2005 | Judd et al. | 455/431 |
| 2005/0203676 | A1 | 9/2005 | Sandell et al. | |
| 2006/0287781 | A1 * | 12/2006 | Bui | 701/3 |
| 2007/0215745 | A1 | 9/2007 | Fleury et al. | |
| 2008/0114504 | A1 * | 5/2008 | Goodman et al. | 701/3 |
| 2008/0154486 | A1 * | 6/2008 | Coulmeau | 701/120 |
| 2008/0163093 | A1 * | 7/2008 | Lorido | 715/771 |
| 2008/0167885 | A1 * | 7/2008 | Judd et al. | 705/1 |

FOREIGN PATENT DOCUMENTS

| | | |
|---|---|---|
| EP | 1 756 789 | 2/2007 |
| EP | 1 923 851 A1 | 5/2008 |
| FR | 2 898 675 | 9/2007 |
| FR | 2 910 124 | 6/2008 |
| FR | 2 913 799 | 9/2008 |
| WO | WO 2006/001851 A2 | 1/2006 |
| WO | WO 2006/001851 A3 | 1/2006 |

OTHER PUBLICATIONS

Preliminary Search Report issued Jul. 8, 2010 in France Application No. FA 729776 (With English Translation of Category of Cited Documents).

* cited by examiner

*Primary Examiner* — Mary Cheung
*Assistant Examiner* — Todd Melton
(74) *Attorney, Agent, or Firm* — Oblon, Spivak, McClelland, Maier & Neustadt, L.L.P.

(57) ABSTRACT

A method for processing a request message received in an aircraft, from air control, via a data transmission system, includes the identification of a type of request contained in the received message and the extraction of parameters associated with the type of request identified. The method further includes steps of determining flight characteristics to be calculated according to the type of request identified and the said associated parameters; selecting at least one calculation module, from among a predetermined set of calculation modules, according to the determined flight characteristics to be calculated; calculating flight characteristics with at least one selected calculation module, and obtaining calculation results; and creating a draft for response to the said request from the calculation results obtained.

16 Claims, 2 Drawing Sheets

Figure 1:
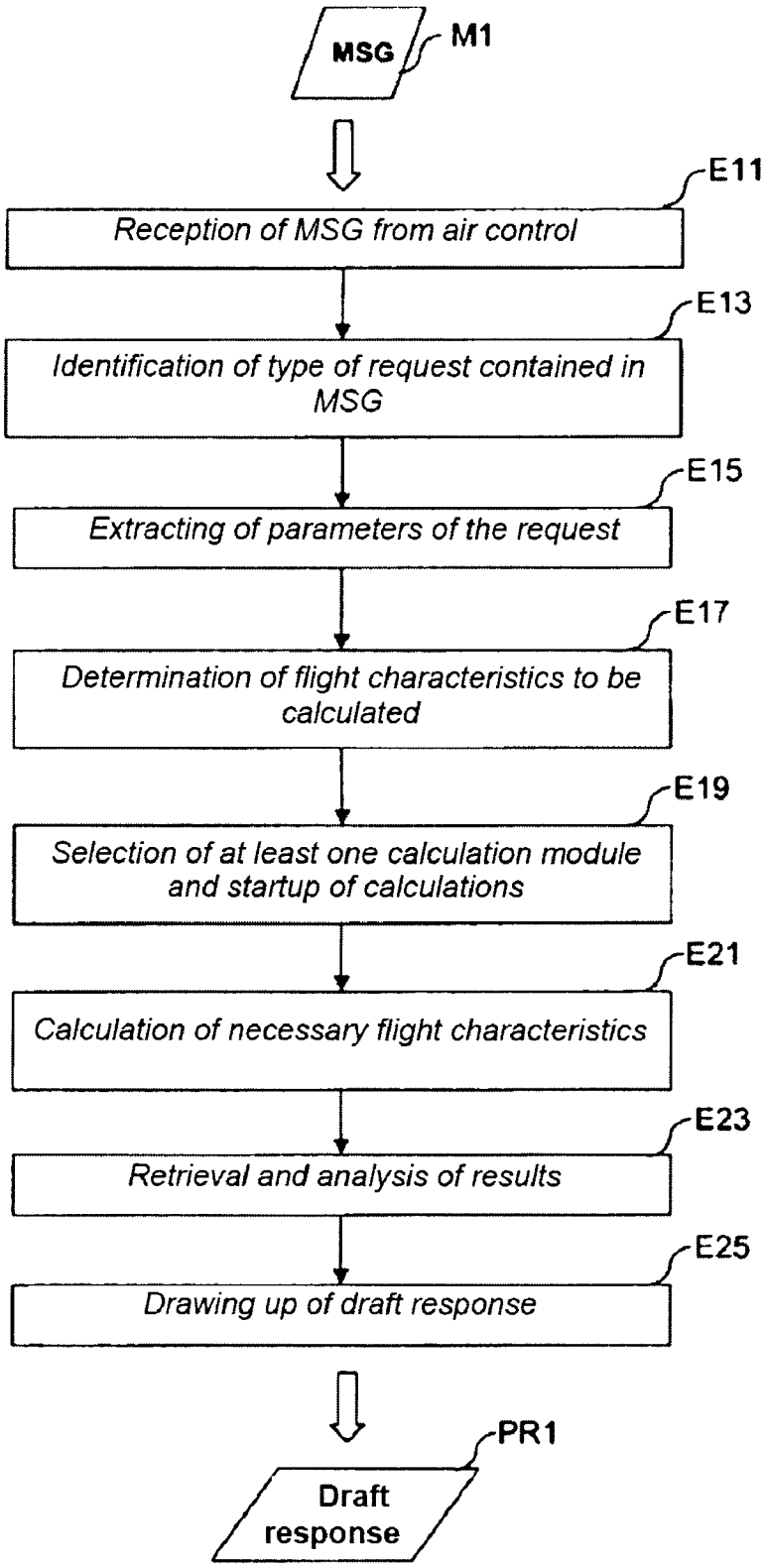

METHOD AND DEVICE FOR PROCESSING A REQUEST MESSAGE RECEIVED IN AN AIRCRAFT, FROM GROUND CONTROL, VIA A DATA TRANSMISSION SYSTEM

This invention relates to the field of air operations using crew-controller exchanges, routed by a CPDLC-type data link. More precisely, the invention concerns a method and a device for processing a request message received in an aircraft, from ground control, via a data transmission system.

Most of the oceanic zones and an increasing number of continental zones (Asiatic in particular, European as of late) provide aircraft with the capacity to exchange written, alphanumeric, climbing or descending messages with ground control, generally with a controller. To date, the air spaces concerned are essentially the upper spaces, that is to say above a certain flight level (typically, above 25,000 feet).

Communication frequencies and protocols are dedicated to these digital exchanges, the frequencies may vary with the zone over-flown, and in particular use satellite communications and/or borrow land networks.

This type of exchange of written messages between ground control and the pilot or the crew of the aircraft is designated by the abbreviation CPDLC denoting controller/pilot communications by data link (Controller/Pilot Data-Link Communications, in English).

The CPDLC communication mode makes it possible to communicate requests coming from the crew or control instructions from the ground called "clearances" (clearances in English), and more generally messages of different types, in the alphanumeric format, composed of plain text or else made up of codified messages with fields that may be parameterized if need be.

The CPDLC mode, which does not use the voice channel, is very advantageous in terms of reliability, quality and robustness as regards errors, in comparison with communication by a vocal channel.

To date, many climbing messages, originating from air control, presuppose the capacity of the aircraft to satisfy one or more of the required parameters, and very particularly when these parameters relate to flight performances of the aircraft, such as, for example, the speed, the altitude or the rate of climb. In certain cases, these climbing messages explicitly ask the pilot questions about the capacity of the aircraft to achieve certain performances.

An exemplary instruction contained in a CPDLC message from ground control is given below. This instruction is the following:

"CROSS [position] AT OR AFTER [time] AT [altitude]"

The above instruction CROSS means: "Pass through the precise point indicated in the field [position] at the precise altitude indicated in the field [altitude] starting from the time indicated in the field [time]."

As illustrated by the above example, it thus is possible for a controller to ask the pilot to reach a given altitude with constraints that the aircraft is unable to meet with the required safety margins, for reasons linked to the physical constraints of the flight, whether they are imposed by the construction features of the aircraft or else due to the flight conditions, such as the weight of the aircraft or the outside temperature at the moment. In other cases, it is arriving at a point at a precise time which will not be possible because it requires an acceleration and speeds physically unattainable by the aircraft.

Furthermore, according to a more basic type of messages, it is frequent for messages merely to ask the pilot for the state of the attainable performances of the aircraft. By way of example, a frequently transmitted message is the following:

"WHEN CAN YOU ACCEPT FL [level]," meaning "At what time will you be able to reach the flight level indicated in the field [level]," for example, 350.

At present, considering the nature of the messages and the international standardization (standards of the Organisation de l'Aviation Civile Internationale (OACI) [International Civil Aviation Organization] under which they fall, the on-board systems for reception of CPDLC messages are able to identify the nature of a received message and, if need be, each of the variable parameters that constitute it, for purposes of a subsequent processing by the pilot.

Nonetheless, considering the various types of messages set forth above, it often is difficult for a pilot to respond to the questions asked or to look ahead to his capacity to respond to a maneuver instruction, because these questions or instructions generally require performing calculations.

These necessary calculations, when they are relatively simple, may be performed manually by the pilot, with the aid of basic calculation tools, such as data charts of paper type or electronic type, or else a hand-held electronic calculator. When they are more complex, however, these calculations may require the use by the pilot of computer resources such as tools integrated into the on-board instruments, such as a flight management system (in English Flight Management System—FMS).

All the same, despite the aforementioned tools available to the pilot, it is difficult for the latter to respond to numerous types of messages. In fact, the systems for reception of messages and the calculation tools mentioned above, even though they make it possible to respond punctually to the questions or queries from the crew, require on the part of the crew:

- recognition of the instruction or the question contained in the message;
- manual execution (data charts, hand-held calculator) and/or startup of calculations performed by specialized calculation systems, often according to a sequence of steps that may combine the two calculation modes: manual and by computer;
- recognition, that is to say retrieval, collation and analysis, of parameters linked to the aircraft (type, engine type, weight, balance, etc.), but also environmental parameters (temperature, winds, weather, etc.) in the vicinity of or along the planned route of the aircraft;
- a series of calculations that may be complex and/or numerous;
- comparison of the results of calculations performed in this way with the air control request;
- then, drawing up of a response and finally sending thereof to ground control.

It is to be noted that the transmitted response may be of two types, depending on whether it follows a message relating to a maneuver request instruction or a message relating to a precise question linked to a capacity of the aircraft. In the first case, the response may indicate simply the pilot's agreement with the maneuver or on the contrary disagreement, if need be with a justification of the inability of the aircraft to carry out the requested maneuver.

In the second case, the response of the crew may consist of a precise, encoded response on the capacity requested of the aircraft—for example: "The 350 level can be reached at 7:56 a.m."—or else a negative response, for example: "Not able to reach the requested level."

It emerges from the foregoing that the workload to which the crew is subjected for processing the requests contained in the messages from air control is considerable.

At the present time, communications in the CPDLC context take place essentially when the flight is in cruising phase.

This situation, however, may well deteriorate in the near future, since it is provided, within the framework of the European project SESAR (new generation European system for air traffic management) or of the American project Next Generation Airspace, that these exchanges be more frequent with more varied messages, and that they also take place in more dynamic flight phases, such as the phases of climbing or descent, phases during which the workload of the crew is greater than at cruising power. In this way, in this new CPDLC communications context, the workload to which the crew is subjected will be even heavier, thus likely to make the processing of such messages even more problematic.

It emerges from the situation set forth above that there is a real need for on-board systems for assistance in processing by the crew of climbing messages from ground control transmitted in a CPDLC environment, especially when these messages require the crew to carry out precise performance calculations, which considerably increases the workload of the crew.

In order to meet the need set forth above, this invention relates, according to a first aspect, to a method for processing a request message received in an aircraft, from air control, via a data transmission system. This method comprises the identification of a type of request contained in the received message and the extraction of parameters associated with the type of request identified, and it is noteworthy in that it further comprises steps of:

- determining flight characteristics to be calculated, according to the type of request identified and the associated parameters;
- selecting at least one calculation module, from among a predetermined set of calculation modules, according to the determined flight characteristics to be calculated;
- calculating the flight characteristics with at least one selected calculation module, and obtaining calculation results;
- creating a draft response to the request from the calculation results obtained.

By virtue of such a method for automatic processing of a message from air control through a CPDLC link, the crew of the aircraft is relieved of the following tasks: recognition of the instruction or the question contained in the message, that is to say the analysis of the flight characteristics to be calculated; execution of calculations, manually or assisted by tools, as explained above, since according to the invention these calculation modules are automatically selected for calculating the characteristics necessary to processing of the message; retrieval, collation and analysis of the intermediate calculation results, with, if need be, manual retrieval of parameters linked to the aircraft or to the flight conditions; lastly, comparison of the final calculation results with the request from air control for a response, before drawing up of a response intended to be sent to air control. In this way, according to the method of the invention, a draft response to the request automatically is provided to the crew.

In this way, implementation of the method according to the invention provides the pilot of an aircraft, such as an airliner, for example, with an aid for processing of requests from air control, making it possible to considerably reduce the workload and attention usually demanded of the pilot for processing these requests.

Consequently, the invention contributes toward further improving safety in air transport. It also makes it possible to increase the efficiency of the air space through a faster and more reliable response given to the requests from control (rightly accepting a maneuver; refusing a clearance that cannot be met).

According to other characteristics of the invention:

- the draft response then is submitted to the crew of the aircraft, via an appropriate man-machine interface;
- the crew, immediately or after modification, via the man-machine interface, validates the draft response to the request, the validation of the draft response activating the sending of a response message intended for ground control;
- the method according to the invention further comprises a step of creating and sending a message of response to the request, the response message being based on the draft response;
- the step of identifying a type of request is preceded by steps of communicating the received request message to the crew via an appropriate man-machine interface, and validating the implementation of the identification step, according to a predetermined action taken by the crew by means of the man-machine interface;
- the received request message is communicated to the crew, via a man-machine interface, concurrently with the step of identifying a type of request;
- the predetermined set of calculation modules comprises at least modules intended respectively for performing one of the following calculation categories: basic calculations of performances of the aircraft, calculations involving use of an electronic version of a draft flight plan, calculations implementing "reverse"-type simulations, calculations involving predominantly manual operations, calculations involving the direct use of the electronic version of the active flight plan.

According to a second aspect, the invention relates to a device for processing a request message received in an aircraft, from ground control, via a data transmission system. According to the invention, this device comprises:

- a module for analysis of messages intended for identifying a type of request contained in the received message, extracting parameters associated with the type of request identified, and determining flight characteristics to be calculated, according to the type of request identified and associated parameters;
- a set of modules for calculation of flight characteristics of different categories;
- a module for selection of calculation resources, intended for selecting at least one calculation module, from among the predetermined set of calculation modules, according to the determined flight characteristics to be calculated, the selected calculation module or modules being in charge of calculating the determined flight characteristics;
- a module for creation of a draft response, intended for creating a draft response to the request from calculation results obtained by the selected calculation module or modules.

According to another aspect, the invention relates to a computer program on an information medium, this program comprising instructions adapted for the implementation of a method for processing a request message received in an aircraft, from air control, according to the invention, such as briefly set forth above, when the program is loaded and run in a computer system.

The advantages obtained with the device for processing an aforementioned request message, as well as with the aforesaid computer program, are identical to those mentioned above in relation to the method for processing a request message, according to the invention, and consequently will not be repeated here.

The invention also has as an object an aircraft equipped with a device for processing request messages, according to the invention, such as set forth above.

Figure 2:
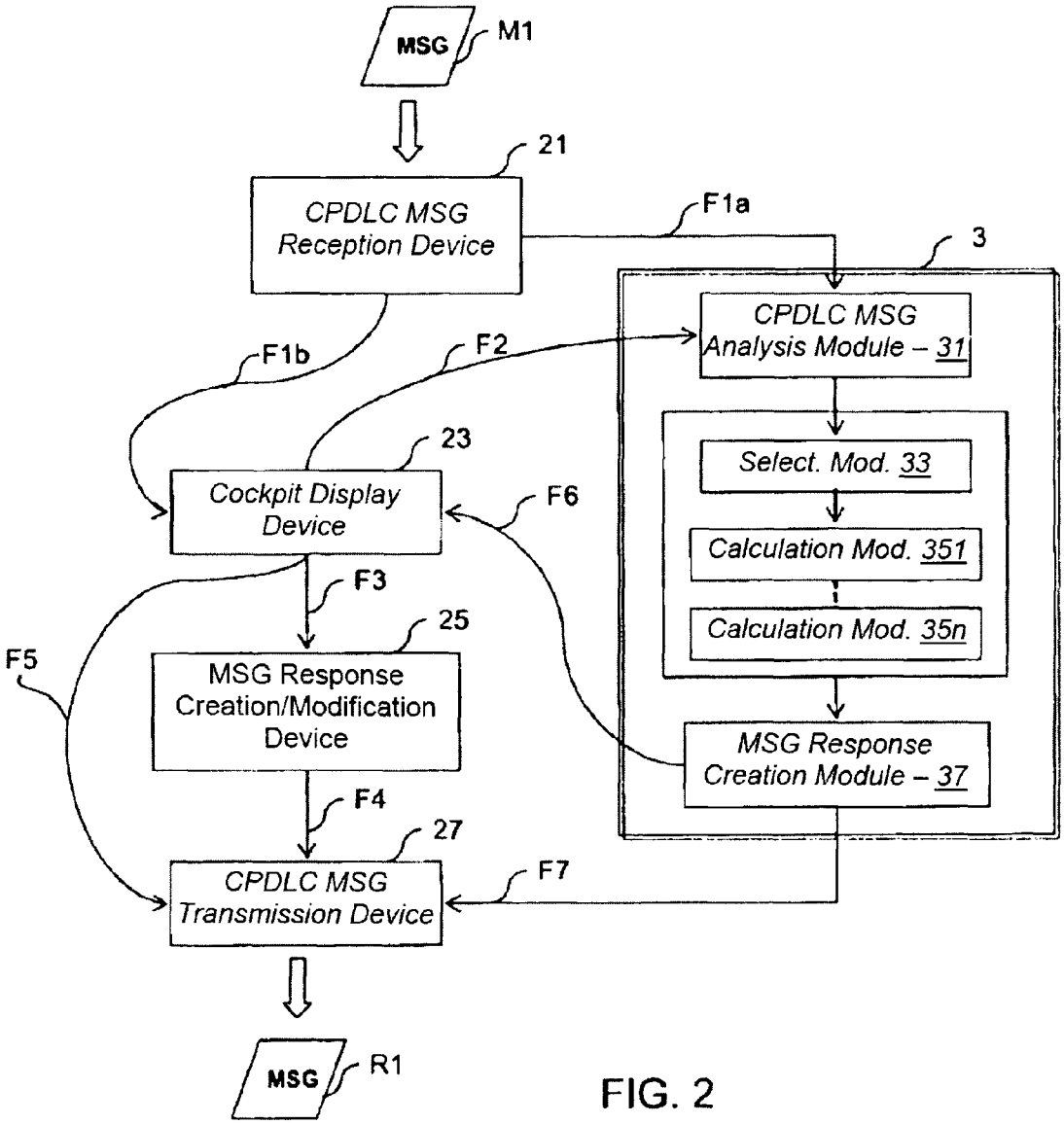

The invention will be better understood with the aid of the detailed description that is going to follow, presented with reference to the attached drawings in which:

FIG. 1 is a flow chart illustrating the principal steps of a method for processing a request message received in an aircraft, from ground control, according to a specific embodiment of the invention; and FIG. 2 shows a system for processing request messages received in an aircraft, from ground control, incorporating a device for processing messages according to the invention.

In connection with FIG. 1, there now are going to be described the principal steps of a method for processing a request message received in an aircraft, from ground control, according to a specific embodiment of the invention. This method is implemented in a system for processing CPDLC messages received in an aircraft, from ground control, such as shown on FIG. 2.

As illustrated on FIG. 1, a message (MSG) M1 from ground control is received via a data transmission system known in itself, adapted for transmitting CPDLC-type communications via a data link. Message M1 is a message, referred to as "climbing," usually containing a request for information items on the part of ground control.

In step E11, climbing message M1 usually is received in the aircraft through a device, known in itself, for reception of CPDLC messages (FIG. 2, 21).

In the course of the following step (E13), the device for reception of CPDLC messages (21) usually identifies a type or category of the request contained in the message (this identification is standardized and deterministic), extracts from the message parameters associated with the type of request identified.

The different types of climbing messages are illustrated in Attachment 1 which appears at the end of the description and which provides a list of some climbing messages (clearances), extracted from document 4444 of the OACI (International Civil Aviation Organization), linked to a performance problem of the aircraft.

Attachment 2, which also appears at the end of the description, provides a list of response messages (descending) that may be used to respond to a performance problem (extract from document 4444 of the OACI), in response to the climbing messages.

Thus, as illustrated by the exemplary messages appearing in Attachment 1, six major categories or types of requests may be defined. These types are referenced marked 0, 1, 1 bis, 2, 3, and 4 in the three tables of Attachment 1.

The category of requests designated by "type 0" corresponds to basic and selective calculations of performances of the aircraft, for example the calculation of the speed envelope according to precise conditions. In this way, in table 3 of Attachment 1, messages bearing the numbers 111, 112, 113 belong to this category, and relate to the increase or decrease of the speed of the aircraft.

The category of requests designated by "type 1" correspond to the calculations involving the use of an electronic version of a draft flight plan, that is to say the direct use of a "flight plan" calculation module and its usual functionalities of prediction in time, speeds, altitudes, weights, of crossing various points of the flight plan, etc. This comes down to an integration modeling of the equations of the flight mechanics.

The category of requests designated by "type 1 bis" in table 2 of Attachment 1 (cf. message No. 58) also corresponds to the calculations involving the use of an electronic version of a draft flight plan, but differs from the aforesaid type 1 by the fact that the draft flight plan is used iteratively, that is to say by iterating its use according to the value of one or more input parameters, until finding the expected result.

The category of results designated by "type 2" in table 1 of Attachment 1 (see, for example, message No. 26) corresponds to calculations carrying out simulations referred to as "reverse." A reverse simulation corresponds to a flight circumstance defined by "forced" conditions, which correspond to a final required situation, deduced directly from the parameters of the climbing message. It will be noted here that the advantage of this type of reverse, that is to say "in decreasing time," algorithm is that it makes it possible to avoid having to implement iterations on an algorithm in "increasing time" when a final very precise flight circumstance is sought.

The category of requests designated by "type 3 in particular in table 1 of Attachment 1 (see, for example, messages No. 171 and 173), relates to requests involving calculations that more often than not are performed "manually" by the pilot, in other words calculations involving predominantly manual operations. These are calculations for which the last generation of flight management computers ((FMS, Flight Management System) do not always implement the algorithms that are at the root of these calculations.

In particular, it is a matter specifically of flight mechanics calculations. For example, instruction 171, in table 1, asks the airplane to climb at a minimum given vertical speed (CLIMB AT (vertical rate) MINIMUM). In order to be able to respond to the message, the pilot must use flight mechanics equations, or even data charts—in paper form or else electronic, when they exist in the electronic flight bags—as explained briefly in the box "Complements and comments" corresponding to this message.

Finally, the category of requests designated by "type 4" in table 2 of Attachment 1 (see, for example, messages No. 55, 56, 57 and 61), relates to requests involving calculations requiring the direct use of the active flight plan, that is to say the flight plan officially followed by the airplane.

Reverting to FIG. 1, as mentioned above, in the course of step E13, the device for reception of CPDLC messages identifies the type or category of the request contained in the received message, that is to say the aforesaid types 0 to 4, and extracts from each message the parameters associated with the type of request identified, in particular the values contained in the fields associated with the instruction corresponding to the request.

In step E17 that follows, the flight characteristics to be calculated are determined according to the type of request identified and the associated parameters. Then, in step E19, the selection of at least one calculation module, from among a predetermined set of calculation modules is undertaken, according to the flight characteristics to be calculated which have been determined. Next, in step E21, the calculations of the flight characteristics necessary for constructing a response to the climbing message are carried out.

More precisely, these calculation modules are adapted respectively for implementing the operations necessary to the processing of each type of request identified, that is to say adapted for carrying out:

- basic calculations of performances of the aircraft;
- calculations involving the use of an electronic version of a draft flight plan;
- calculations implementing "reverse"-type simulations;
- calculations automating the manual operations usually required for the type-3 requests mentioned above;
- calculations involving the direct use of the electronic version of the active flight plan.

In step E23 that follows, the results of the calculations carried out by the selected calculation module or modules are retrieved and analyzed. Finally, in step E25, a draft response (PRI) to the request contained in the received message is automatically drawn up from the calculation results obtained.

In practice, the message processing method according to the invention may comprise, according to the embodiment chosen, one or more of the following steps (not shown on FIG. 1):

- Submission of the draft response to the crew of the aircraft, via an appropriate man-machine interface.
- Validation by the crew, immediately or after modification, via an appropriate man-machine interface, of the draft response to the request; the validation of the draft response activating the sending of the response message to ground control.
- Creation and sending of a final message for response to the request, this final response message being based on the draft response.

Moreover, according to a specific embodiment, the identification of a type of request is preceded by the steps of:

- communicating the received request message to the crew, via an appropriate man-machine interface;
- validating the implementation of the identification step, according to a predetermined action taken by the crew by means of the man-machine interface.

It also may be provided that the received request message is communicated to the crew, via a man-machine interface, concurrently with the step of identifying a type of request.

FIG. 2 shows a system for processing of request messages received in an aircraft, from ground control, incorporating a message-processing device according to the invention. This message-processing device bears reference number 3 on FIG. 2.

As shown on FIG. 2, the device for processing a request message according to the invention comprises the following modules:

- a module 31 for analysis of messages intended for identifying a type of request contained in the received message, extracting parameters associated with the type of message identified, and determining flight characteristics to be calculated, according to the type of request identified and the associated parameters;
- a set of n modules ($\mathbf{35}_1$-$\mathbf{35}_n$) for calculation of flight characteristics of different categories;
- a module 33 for selection of calculation resources, intended for selecting at least one calculation module from among the predetermined set of calculation modules, according to the determined flight characteristics to be calculated, the selected calculation module or modules being in charge of calculating the determined flight characteristics;
- a module 37 for creation of a draft response, intended for creating a draft response to the request from the calculation results obtained by the selected calculation module or modules.

Module 37 for creation of a draft response thus automatically draws up a draft response message, according to the climbing message (originating from the controller) and the calculation results produced by the appropriate modules or modules. Such a draft response is in accordance with the standardized descending (downlink) response messages, indicated in the tables of Attachment 2.

Such a response message may consist of one or more descending messages provided for by the standardization (cf. Attachment 2). By way of examples, in Attachment 2:

- the message numbered '3' means "Received" (ROGER), without other comments because the initial instruction does not pose any problem;
- the message numbered '0' means "OK, I accept the request," a response for example to a categorical trajectory request from the controller;
- the message numbered '1' means: "I am unable to carry out the requested trajectory" and may be linked to a message numbered 66 meaning "For performance reasons";
- the message numbered 81 means: "I can carry out the requested change of level," by displaying the fields "level" (level) and "time" (time) in the following manner. The parameter "level" is the one contained in the request from the controller, and the parameter "time" is the one originating from the calculation; if the calculation indicates that the change of level may be carried out immediately, the parameter "time" will be the time of drawing up of the draft message or, in a variant, the time of transmission to the ground.

Reverting to FIG. 2, the system for processing of CPDLC messages usually comprises:

- a device 23 for reception of messages (MSG) M1;
- a device 25 for creation and/or modification, non-automatic, of response messages;
- a device for transmission of response messages (MSG) (descending messages) R1.

According to a specific embodiment, processing device 3 according to the invention further comprises a module for submission (not shown) of the draft response drawn up, to the pilot or the crew of the aircraft, via an appropriate man-machine interface, for example cockpit display device 23.

As mentioned above, calculation modules $\mathbf{35}_{(1\text{-}n)}$ automate the processing usually implemented manually by the crew, or by means of calculation tools controlled or manipulated by the crew.

Thus, in practice, calculation modules $\mathbf{35}_{(1\text{-}n)}$ implement, at least in part, the detailed technical specifications (DTS) of the flight management system (Flight Management System—FMS), such as, for example, those relating to the calculation of speed envelopes, or else use known flight mechanics equations (propulsion equation, for example).

For "type 1" requests, the automatic processing implemented by the selected calculation module comprises in particular the following operations:

- creation of a draft flight plan by copying the current active flight plan;
- modification of the flight parameters (for example, climb from a precise point to a designated flight level), or addition of a constraint;
- retrieval of the calculation results;
- extraction of the items necessary to the drawing up of the response (for example, ability or inability to return to the flight level included in the draft);
- drawing up of the response to the question and display of the response in the cockpit.

As a variant, for type 1, 1 bis or 2 messages, the simulation calculations may use simplified modellings—that is to say not using predictive calculations to start with, such as allowances or a Bréguet formula, for example—in order to improve the response times. In fact, the use of a predictive draft flight plan calculation already basically uses precise but more complex algorithms and may prove to be costly in calculation time.

For type 2 requests, the automatic processing performed by the selected calculation module consists in using a reverse simulation. To this end, the known laws of time regression are used to model in reverse order (in the sense of increase) the evolution of the weight, the lateral trajectory, the speeds and the altitude of the aircraft. The reverse simulation is interrupted for a given flight condition and the predictions are retrieved. Then, the items necessary to the drawing up of the response to the request message are extracted, for example the ability or inability to return to the flight level included in the draft. The response to the question finally is drawn up and displayed in the cockpit.

For type 3 requests, the automatic processing of the manual operations, mentioned above, usually required for type 3 requests, for example flight mechanics calculations.

For type 4 requests, the automatic processing carried out by the selected calculation module in particular consists in:

- the retrieval of predictions of the current active flight plan;
- for the position, the time or the speed provided in parameters of the request (CPDLC clearance), retrieval of conditions relating to the airplane (for example the weight) and the environment (for example temperature or winds predicted);
- calculation of selective performances around the flight point defined above, the same type of calculations as those intended for type 0 calculations set forth above (for example, speed envelope, usual performance calculation) is involved there.

The functioning of the message processing system shown in FIG. 2 is the following. According to a selected embodiment, reception device 21 communicates (arrow F1*b*) the received request message M1 to the crew, via cockpit display device 23, and at the same time transmits it (arrow F1*a*) to the message analysis module for identification of the type of request.

As a variant, as shown by successive arrows F1*b* and F2, the received message first is communicated (arrow F1*b*) to the crew, via an appropriate man-machine interface, here display device 23. Then, in response to a validation by the crew by means of an appropriate control interface, the identification operation is activated and the received message is transmitted to analysis module 31 (arrow F2).

According to one embodiment, the draft response drawn up by module 37 for creation of draft responses, is transmitted (arrow F6) systematically to display device 23 and in this way submitted to the crew. In this case, the crew may modify the response message via Creation/Modification device 25 (arrow F3)—as is the case in the state of the art—then activate sending thereof (arrow F4). The crew also may activate sending of the message immediately without modifying it (arrow F5).

In an implementation variant, message creation module 37 may transmit the response message immediately and automatically to transmission device 27, as shown by arrow F7.

In practice, the aforesaid modules making up a message processing device 3 according to the invention are implemented in the form of software modules, that is to say one or more computer programs forming a set and comprising instructions adapted for the implementation of the method for processing a request message, according to the invention. A method according to the invention consequently is implemented when this or these programs is/are loaded and run in an on-board computer system in the aircraft.

It likewise will be noted that a computer program according to the invention, the purpose of which is the implementation of the invention when it is run by an appropriate computer system, may be stored on an information medium of varying types. In fact, such an information medium may consist of any apparatus or device able to store a program according to the invention.

For example, the medium in question may comprise a hardware storage means, such as a ROM, for example a CD ROM or a microelectronic circuit ROM, or even a magnetic recording means, for example a diskette or a hard disk. As a variant, the information medium may be an integrated circuit in which the program is incorporated, the circuit being used for the implementation of the method considered.

From a design point of view, a computer program according to the invention may use any programming language and be in the form of source code, object code, or code intermediate between source code and object code (e.g., a partially compiled form) or in any other desirable form for implementing a method according to the invention.

Attachment 1

Extracts from Lists of Climbing Messages (Clearances) Linked to a Performance Problem (Extract from Document 4444 of the OACI)

TABLE 1

| Vertical clearances | | | | | |
|---|---|---|---|---|---|
| No. | Message intention/use | Message | Return MSG No. | Type of calculation | Complements and comments |
| 6 | Notification that an instruction for change of level is to be expected. | EXPECT (level) | 3 if OK; 82 and 66 if unable | 1 | Use of the STEP ALT function: (level) and observation of the response (able or unable) |
| 7 | Notification that an instruction is to be expected telling the aircraft to begin to climb at the specified time. | EXPECT CLIMB AT (time) | 3 if OK; 1 and 66 if unable | 1 | 1) Determination of the airplane position and weight at (time)<br>2) Use of the STEP ALT function: current level + 2000 ft<br>3) Observation of the response (able or unable) |
| 19 | Instruction to maintain the specified level. | MAINTAIN (level) | 0 if OK; 1, 82 & 66 if unable | 1 | |
| 24 | Instruction to initiate a descent to a specified level at a specified time, and to maintain the | AT (time) DESCEND TO (level) | 0 if OK; 1 & 66 if unable | 1 | |

TABLE 1-continued

| Vertical clearances | | | | | |
|---|---|---|---|---|---|
| No. | Message intention/use | Message | Return MSG No. | Type of calculation | Complements and comments |
| | specified level once reached. | | | | |
| 26 | Instruction to initiate a climb at a rate such that the specified level is reached at or before the specified time. | CLIMB TO REACH (level) BY (time) | 0 if OK; 1 & 66 if unable | 2 | Final required conditions: altitude equal to (level), speed equal to the current speed, weight calculated by virtue of an allowance for load shedding on climb. Reverse calculation of climb. The sum of the duration of climb and the current time in relation to (time) remains to be compared. |
| 27 | Instruction to initiate a climb at a rate such that the specified level is reached at or before the specified position. | CLIMB TO REACH (level) BY (position) | 0 if OK; 1 & 66 if unable | 2 | Final required conditions: altitude equal to (level), speed equal to the current speed, weight calculated by virtue of an allowance for load shedding on climb. Reverse calculation of climb. The sum of the climb distance and the current position in relation to (position) remains to be compared. |
| 28 | Instruction to initiate a descent at a rate such that the specified level is reached at or before the specified time. | DESCEND TO REACH (level) BY (time) | 0 if OK; 1 & 66 if unable | 2 | Final required conditions: altitude equal to (level), speed equal to the current speed, weight calculated by virtue of an allowance for load shedding on descent. Reverse calculation of the descent. The sum of the descent duration and the current time in relation to (time) remains to be compared. |
| 29 | Instruction to initiate a descent at a rate such that the specified level is reached at or before the specified position. | DESCEND TO REACH (level) BY (position) | 0 if OK; 1 & 66 if unable | 2 | Final required conditions: altitude equal to (level), speed equal to the current speed, weight calculated by virtue of an allowance for load shedding on descent. Reverse calculation of descent. The sum of the descent distance and the current position in relation to (position) remains to be compared. |
| 192 | Instruction to continue a change of level, but at a rate such that the specified level is reached at or before the specified time. | REACH (level) BY (time) | 0 if OK; 1 & 66 if unable | 2 | Testing the requested level (level) is going to involve a climb or a descent, then reference to messages 26 or 28 |
| 209 | Instruction that a change of level is to be continued, but at a rate such that the specified level is reached at or before the specified position. | REACH (level) BY (position) | 0 if Ok; 1 & 66 if unable | 2 | Testing the requested level (level) is going to involve a climb or a descent, then reference to messages 27 or 29 |
| 171 | Instruction to climb with a rate greater than or equal to the specified rate. | CLIMB AT (vertical rate) MINIMUM | 0 if Ok; 1 & 66 if unable | 3 | Use of Flight Mechanics (propulsion equation) with set total gradient (current airplane configuration, max climb power) and use of current speed law (constant CAS or Mach). The maximum vertical speed is deduced from these hypotheses. |
| 173 | Instruction to descend with a rate greater than or equal to the specified rate. | DESCEND AT (vertical rate) MINIMUM | 0 if Ok; 1 & 66 if unable | 3 | Use of Flight Mechanics (propulsion equation) with set total gradient (current airplane configuration, idle power) and use of current speed law |

TABLE 1-continued

| Vertical clearances | | | | | |
|---|---|---|---|---|---|
| No. | Message intention/use | Message | Return MSG No. | Type of calculation | Complements and comments |
| | | | | | (constant CAS or Mach). The minimum vertical speed is deduced from these hypotheses. Variant: use of the speed brakes may be accepted. |

TABLE 2

| Crossing constraints | | | | | |
|---|---|---|---|---|---|
| No. | Message intention/use | Message | Return MSG No. | Type of calculation | Complements and comments |
| 55 | Instruction to cross the specified position at the specified speed which then is to be maintained until further command. | CROSS (position) AT (speed) | 0 if OK; 1 & 66 if unable | 4 | Retrieval of the aforesaid information items (weight, level. wind and T°) at the waypoint "position," then calculation of speed envelopes. |
| 56 | Instruction to cross the specified position with a speed less than or equal to the specified speed, and then to keep to a speed less than or equal to the specified speed until further command. | CROSS (position) AT OR LESS THAN (speed) | 0 if OK; 1 & 66 if unable | 4 | Retrieval of the aforesaid information items (weight, level. wind and T°) at the waypoint "position," then calculation of speed envelopes. |
| 57 | Instruction to cross the specified position with a speed greater than or equal to the specified speed, and then to keep to a speed greater than or equal to the specified speed until further command. | CROSS (position) AT OR GREATER THAN (speed) | 0 if OK; 1 & 66 if unable | 4 | Retrieval of the aforesaid information items (weight, level. wind and T°) at the waypoint "position," then calculation of speed envelopes. |
| 58 | Instruction to cross the specified position at the specified time and at the specified level. | CROSS (position) AT (time) AT (level) | 0 if OK; 1 & 66 if unable | 1 bis | Iteration on the starting point of climb/descent and the flight speeds (use of a virtual Cost Index (CI) for example) |
| 61 | Instruction to cross the specified position at the specified speed and level, and then to maintain the level and the speed. | CROSS (position) AT AND MAINTAIN (level) AT (speed) | 0 if OK; 1 & 66 if unable | 4 | 1) Retrieval of the predictions originating from the Active flight plan, for the requested (position)<br>2) calculation of lightening taking into account the climb to (level)<br>3) calculation of speed envelope |

TABLE 3

| Changes in speed | | | | | |
|---|---|---|---|---|---|
| No. | Message intention/use | Message | Return MSG No. | Type of calculation | Complements and comments |
| 111 | Instruction to increase the current speed to the specified speed and to maintain this speed until further command. | INCREASE SPEED TO (speed) | 0 if OK, 1, 84 & 86 if unable | 0 | |
| 112 | Instruction to increase the current speed to reach a speed greater than or equal to the specified speed, then to maintain or exceed this speed until further command. | INCREASE SPEED TO (speed) OR GREATER | 0 if OK, 1, 84 & 86 if unable | 0 | |
| 113 | Instruction to reduce the current speed to the specified speed and to maintain this speed until further command. | REDUCE SPEED TO (speed) | 0 if OK, 1, 84 & 86 if unable | 0 | |

TABLE 4

| Negotiation requests | | | | | |
|---|---|---|---|---|---|
| No. | Message intention/use | Message | Return MSG No. | Type of calculation | Complements and comments |
| 148 | Request for closest time when the specified level may be accepted. | WHEN CAN YOU ACCEPT (level) | 81 if OK; 82 if unable | 1 bis | If descent, no performance problem. For climb, iteration on time of start of climb to (level).<br>Understood at Iso Mach.<br>By default, the desired precision is at one minute. |
| | | | | 3 | Variant for message 148 (case of climb):<br>1) calculation of load shedding climb to (level)<br>2) calculation of load shedding/unit of time in cruising flight according to current hypotheses<br>3) Iteration on envelope calculation at (level) to determine the minimal weight necessary to activate climb<br>4) Conversion of the weight obtained in 3 into time, by virtue of points 1) and 2). |

Attachment 2

List of Descending Messages that May be Used to Respond to a Performance Problem (Extract from Document 4444 of the International Civil Aviation Organization)

TABLE A5-13

Responses (downlink)

| | Message intent/use | Message element | URG | ALRT | RESP |
|---|---|---|---|---|---|
| 0 | The instruction is understood and will be complied with. | WILCO | N | M | N |
| 1 | The instruction cannot be complied with. | UNABLE | N | M | N |
| 2 | Wait for a reply. | STANDBY | N | M | N |
| 3 | Message received and understood. | ROGER | N | M | N |
| 4 | Yes. | AFFIRM | N | M | N |
| 5 | No. | NEGATIVE | N | M | N |

TABLE A5-23

Additional messages (downlink)

| | Message intent/use | Message element | URG | ALRT | RESP |
|---|---|---|---|---|---|
| 65 | Used to explain reasons for pilot's message. | DUE TO WEATHER | L | L | N |
| 66 | Used to explain reasons for pilot's message. | DUE TO AIRCRAFT PERFORMANCE | L | L | N |

TABLE A5-24

Negotiation responses (downlink)

| | Message intent/use | Message element | URG | ALRT | RESP |
|---|---|---|---|---|---|
| 81 | We can accept the specified level at the specified time. | WE CAN ACCEPT (level) AT (time) | L | L | N |
| 115 | We can accept the specified level at the specified position. | WE CAN ACCEPT (level) AT (position) | L | L | N |
| 82 | We cannot accept the specified level. | WE CANNOT ACCEPT (level) | L | L | N |
| 83 | We can accept the specified speed at the specified time. | WE CAN ACCEPT (speed) AT (time) | L | L | N |
| 116 | We can accept the specified speed at the specified position. | WE CAN ACCEPT (speed) AT (position) | L | L | N |
| 84 | We cannot accept the specified speed. | WE CANNOT ACCEPT (speed) | L | L | N |
| 85 | We can accept a parallel track offset the specified distance in the specified direction at the specified time. | WE CAN ACCEPT (specified distance) (direction) AT (time) | L | L | N |
| 117 | We can accept a parallel track offset the specified distance in the specified direction at the specified position. | WE CAN ACCEPT (specified distance) (direction) AT (position) | L | L | N |
| 86 | We cannot accept a parallel track offset the specified distance in the specified direction. | WE CANNOT ACCEPT (specified distance) (direction) | L | L | N |

Note.
Wherever the variable "level" is specified, the message can specify either a single level or a vertical range, i.e. block level.

The invention claimed is:

1. A method for processing a request message received in an aircraft from ground control via a data transmission system, the method comprising:

identifying a type of request contained in the received message;

extracting parameters associated with the type of request identified;

determining flight characteristics to be calculated according to the type of request identified and the associated parameters;

selecting at least one calculation module from among a predetermined set of calculation modules according to the determined flight characteristics to be calculated;

calculating the flight characteristics with the at least one selected calculation module and obtaining calculation results;

creating a draft response to the request from the calculation results obtained;

providing an option for a crew action to modify the draft response to produce a modified draft response; and sending a response message including one of the draft response or the modified draft response based on a crew action.

2. The method according to claim 1, further comprising:

submitting the draft response to crew of the aircraft via a man-machine interface.

3. The method according to claim 2, further comprising:

receiving an indication of a crew validation, immediately or after modification, via the man-machine interface, of the draft response to the request, the receipt of the indication of the crew validation of the draft response activating the sending of the response message to ground control.

4. The method according to claim 1, further comprising:

creating and sending the response message to the request, the response message being based on the draft response.

5. The method according to claim 1, wherein the identifying the type of request is preceded by:

communicating the request message to crew of the aircraft via a man-machine interface; and validating the type of request identified by the identifying according to a predetermined action taken by the crew using the man-machine interface.

6. The method according to claim 1, further comprising:

communicating the received request message to crew of the aircraft via a man-machine interface concurrently with the identifying the type of request.

7. The method according to claim 1, wherein the predetermined set of calculation modules includes modules that perform one of the following:

basic calculations of performances of the aircraft;

calculations involving the use of an electronic version of a draft flight plan;

calculations implementing "reverse"-type simulations;

calculations involving predominantly manual operations; or calculations involving a direct use of an electronic version of an active flight plan.

8. A device for processing a request message received in an aircraft from ground control via a data transmission system, the device comprising:

an analysis module, executed by a processor that analyzes the received message identifies a type of request contained in the received message, extracts parameters associated with the type of request identified, and determines flight characteristics to be calculated, according to the type of request identified and the associated parameters;

a set of calculation modules that calculate the flight characteristics of different categories;

a selection module that selects at least one calculation module from among the set of calculation modules according to the determined flight characteristics to be calculated, the at least one selected calculation module being in charge of calculating the determined flight characteristics;

a response module that creates a draft response to the request from the calculation results obtained with the at least one selected calculation module;

a modification module that provides an option for a crew action to modify the draft response to produce a modified draft response; and a response module that sends a response message including one of the draft response or the modified draft response based on a crew action.

9. The device according to claim 8, further comprising:

a submission module that submits the draft response to crew of the aircraft via a man-machine interface.

10. The device according to claim 9, further comprising:

a validation section that receives an indication of a crew validation of the draft response from the crew.

11. The device according to claim 8, further comprising:

a response module that creates and sends a response message in response to the request, the response message being based on the draft response.

12. The device according to claim 8, further comprising:

a man-machine interface configured to communicate the request message to crew of the aircraft; and a validation module configured to validate the type of request identified by the analysis module according to a predetermined action taken by the crew using the man-machine interface.

13. The device according to claim 8, further comprising:

a man-machine interface configured to communicate the received request message to crew of the aircraft concurrently with the analysis module identifying the type of request.

14. The device according to claim 8, wherein the set of calculation modules includes modules that perform one of the following:

basic calculations of performances of the aircraft;

calculations involving the use of an electronic version of a draft flight plan;

calculations implementing "reverse"-type simulations;

calculations involving predominantly manual operations; or calculations involving a direct use of an electronic version of an active flight plan.

15. An aircraft comprising:

a device for processing of a request message received from ground control via a data transmission system, the device including an analysis module executed by a processor that analyzes the received message, identifies a type of request contained in the received message, extracts parameters associated with the type of request identified, and determines flight characteristics to be calculated, according to the type of request identified and the associated parameters;

a set of calculation modules that calculate the flight characteristics of different categories;

a selection module that selects at least one calculation module, from among the set of calculation modules according to the determined flight characteristics to be calculated, the at least one selected calculation module being in charge of calculating the determined flight characteristics;

a response module that creates a draft response to the request from the calculation results obtained with the at least one selected calculation module;

a modification module that provides an option for a crew action to modify the draft response to produce a modified draft response; and a response module that sends a response message including one of the draft response or the modified draft response based on a crew action.

16. A computer readable medium storing program instructions adapted for implementing a method for processing a request message received in an aircraft from ground control via a data transmission system when executed by a computer, the method comprising:

identifying a type of request contained in the received message;

extracting parameters associated with the type of request identified;

determining flight characteristics to be calculated according to the type of request identified and the associated parameters;

selecting at least one calculation module from among a predetermined set of calculation modules according to the determined flight characteristics to be calculated;

calculating the flight characteristics with the at least one selected calculation module and obtaining calculation results;

creating a draft response to the request from the calculation results obtained;

providing an option for a crew action to modify the draft response to produce a modified draft response; and sending a response message including one of the draft response or the modified draft response based on a crew action.

* * * * *